United States Patent [19]

Rutishauser et al.

[11] 4,268,021

[45] May 19, 1981

[54] TRANSPORTATION ARRANGEMENT FOR SHEETLIKE RECORDING CARRIERS

[75] Inventors: Thomas Rutishauser, Uerikon; Roland Reichlin, Zurich; Claudius Viviani, Mönchaltorf; Albert Rutishauser, Uerikon, all of Switzerland

[73] Assignee: Rutishauser Data AG, Stafa, Switzerland

[21] Appl. No.: 4,925

[22] Filed: Jan. 19, 1979

[30] Foreign Application Priority Data

Jan. 23, 1978 [CH] Switzerland ..... 679781/78

[51] Int. Cl.[3] ..... B65H 3/06; B65H 5/06; B65H 29/22

[52] U.S. Cl. ..... 271/4; 271/110; 271/116; 271/178; 400/625; 400/629; 400/636.2; 400/708

[58] Field of Search ..... 271/4, 10, 110, 111, 271/116, 114, 178; 400/624, 625, 629, 636.2, 708, 708.1

[56] References Cited

U.S. PATENT DOCUMENTS

| | | | |
|---|---|---|---|
| 2,366,206 | 1/1945 | Metzner | 400/625 |
| 3,524,639 | 8/1970 | Smith et al. | 271/10 |
| 3,776,545 | 12/1973 | White | 271/116 X |

FOREIGN PATENT DOCUMENTS

| | | | |
|---|---|---|---|
| 28191 | of 1909 | United Kingdom | 271/178 |

*Primary Examiner*—Bruce H. Stoner, Jr.
*Attorney, Agent, or Firm*—Cushman, Darby & Cushman

[57] ABSTRACT

Only the topmost sheet (12) of a stack is fed from a supply box (10) by transportation rolls (16) by way of a separating arrangement (18) to a pair of transportation rolls (20, 22). This pair transports the sheet further until the ray of a light (66) is interrupted and as a result the coupling (26) is uncoupled. As soon as the platen (32) driven by a line stepped motor (30) assumes a starting position, the coupling (26) is again engaged. The peripheral speeds of the rolls (20, 22) and of the platen (32) corresponds to one another so that the platen (32) together with a contact pressure roll may accept the sheet. After lettering, the sheet is transported by the pair of rolls (34, 36) into a file box. The pair of transportation rolls (20, 22) as well as the transportation rolls (16) are driven via a belt (50, 54) by platen drive (30).

7 Claims, 3 Drawing Figures

Figure 1:
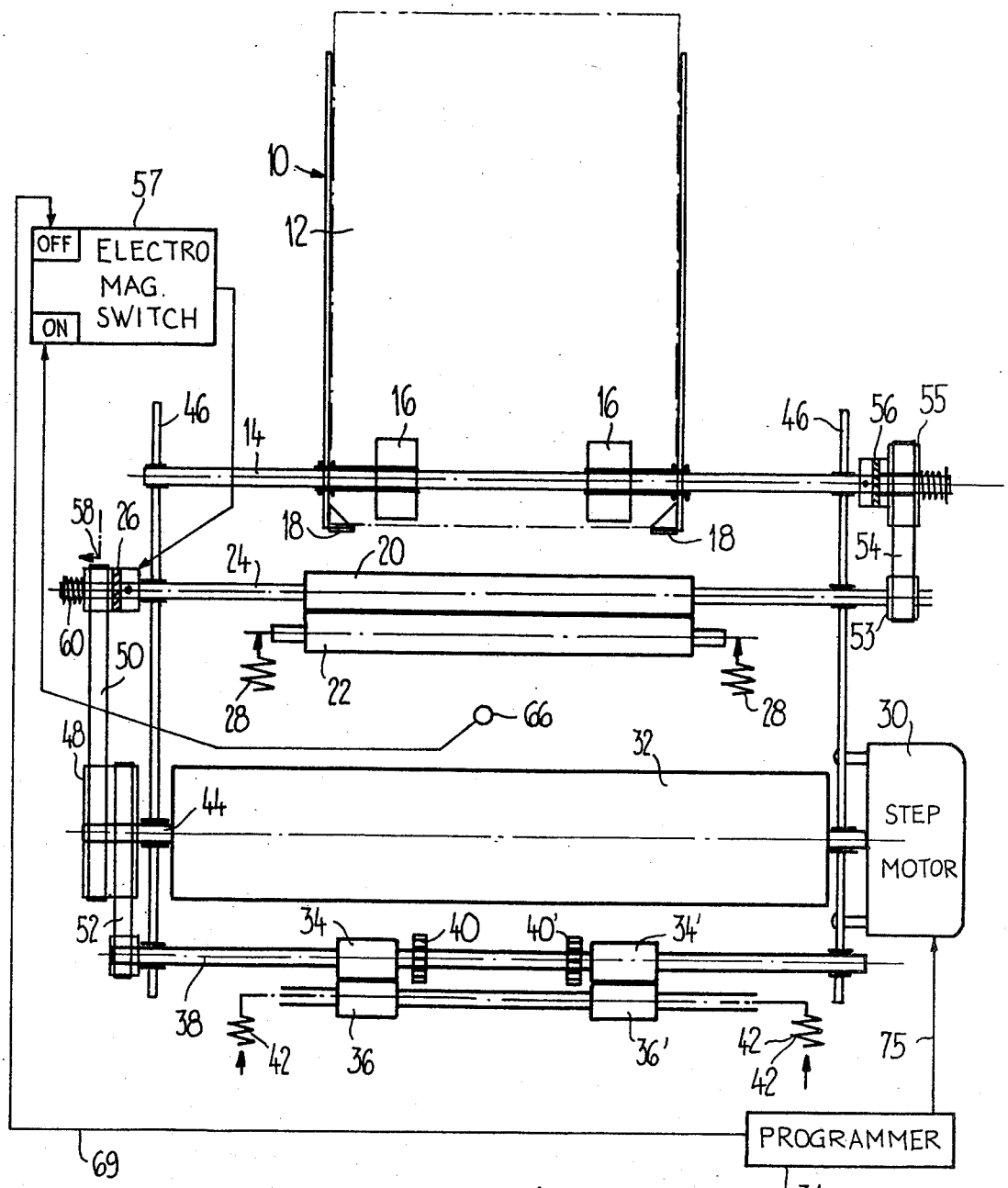

80
76
12
10
64
16
14
12'
54
24
62
42
36
34
40
20
22
50
52
28
66
(SENSOR)
74
67
(LIGHT SOURCE)
32
70
72
44
68
12'
12'
12"
80
76
36
34
40
78

TRANSPORTATION ARRANGEMENT FOR SHEETLIKE RECORDING CARRIERS

This invention relates to a transportation arrangement for sheetlike recording carriers, with at least one transportation roll for the conveyance of always one sheet from a stack to a driven platen. Such a transportation arrangement may be, for example, an equipment group of an automatic recorder or of a printer.

In the case of a known transportation arrangement of this type, the transportation roll feeding the sheet to the platen is driven by an additional motor independently of the drive of the platen. At the same time, the sheet is fed to the platen up to a first contact pressure roll cooperating with the platen. The platen seizes the sheet and transports it on in a program controlled manner. After the lettering, a cooperating pair of rolls transports the sheet from the platen into a filing box. Thereupon, the platen seizes the next sheet fed to it for lettering, so that a continuous operating cycle may take place until the supply stack of sheets has been used up.

Such a transportation arrangement of a known construction is not only expensive because of the additional motor required for the transporting rolls but it also does not stop the sheet fed to the platen reliably on the predetermined spot, because, for example, the running down of the assigned motor is subject to fluctuations. As a result of that, interruptions may develop in case of seizing of the sheet by the platen. Furthermore in that case, there is the danger that the sheet is positioned imprecisely in case of lettering so that in the case of lettering of forms, mistakes may occur which are misleading as to sense.

Therefore, the invention is based on the task of creating a transportation arrangement of the initially mentioned type which requires no additional driving motor for feeding the sheet to the platen and which guarantees a precise positioning of the sheet fed to the platen. Furthermore, the transportation arrangement should also make possible a perfect transportation of the lettered sheet from the platen into a filing box.

The solution of the task set will succeed according to the invention through the fact that in the path of conveyance of the sheet between the transportation roll and the platen, a cooperating pair of transportation rolls is disposed which is connected with the drive of the platen by way of a releasable coupling and which may be synchronized with the platen.

In such an arrangement three essential advantages are interconnected. First of all, an additional motor is saved, secondly a precise positioning of the sheet is guaranteed and thirdly, the pair of transportation rolls may be more easily synchronized with the platen. The precise positioning is possible because the pair of transportation rolls rotating at a relatively low rpm will be at a standstill momentarily in case of releasing the coupling, since its rotative moment is very small as compared to a fast running armature of a motor. The synchronization of the pair of transportation rolls with the platen offers no problems because the same source of driving is used for both elements.

According to a preferred embodiment, the releasable coupling may be controlled by a position detecting element disposed between the pair of transportation rolls and the platen, which element responds to the feed of the sheet.

Figures 2, 3:
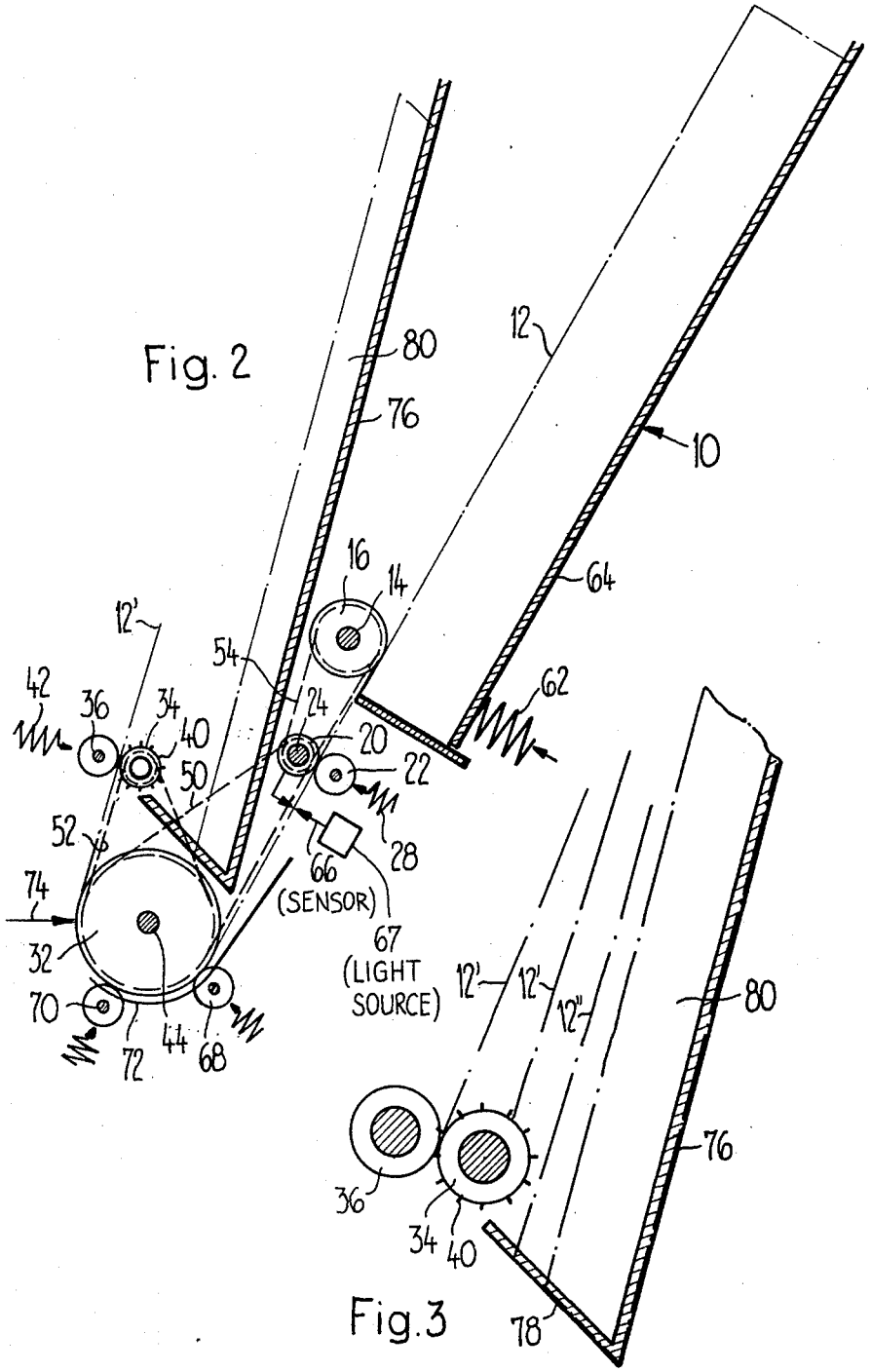

In addition preferred embodiments have been described, the advantages of which result from the succeeding description of an embodiment shown by way of example. The embodiment will be explained in more detail on the basis of the drawings, in which:

FIG. 1 shows a transportation arrangement in top view with the transportation elements shown in a plane for the sake of improved clarity, FIG. 2 shows the transportation arrangement in longitudinal cut through the path of conveyance of the sheet, and FIG. 3 shows the transportation of the sheet into the filing box at an enlarged presentation as compared to FIG. 2.

In FIG. 1, sheets 12 are stacked for removal in a supply box 10. At the lower end of the box 10, there are two transportation rolls 16 disposed at a distance on a shaft 14, which are, for example, covered with rubber and which always press onto the sheet 12 lying on top. In order to guarantee that always only a single one of the sheets 12 in FIG. 1 will be pushed away, downwards by the transportation rolls 16, the supply box 10 at its two corners lying in the path of transportation has angular stop surfaces 18, which must be skipped or jumped over by the corners of the removed sheet lying forward in the direction of transportation. These stop surfaces 18 thus act as a separating mechanism.

The sheet removed from the supply box 10 by the transportation rolls 16 subsequently arrives between a pair of transportation rolls 20, 22. The roll 20 has been fixedly rotatably connected with the shaft 24 and is driven by way of a releasable coupling or electromagnetic clutch 26. The roll 22 cooperating with the roll 20 of the pair of rolls is pressed against the roll 20 by springs 28.

The next element in the conveying path of the sheet is the platen 32 driven by a drive 30 which is a line stepping motor. Programmer 31 of known kind such as a data machine of any sort, for example for processing a magnetic card containing a program that an automatic typewriter should follow to complete a form letter, causes drive motor 30 to step platen 32 an angular distance corresponding on a sheet 12 to one line or a multiple thereof according to the program as is well known. Contact pressure rolls, not shown in this figure, press against the platen 32. Two cooperating pairs of rolls 34, 36; 34′ 36′ succeed the platen 32 in the direction of conveyance. The two rolls 34 and 34′ are disposed fixed in rotation on a shaft. Furthermore, sprockets 40, 40′ are located on the shaft 38, the teeth of which project beyond the jacket or peripheral surfaces of the rolls 34, 34′. The rolls 36 and 36′ are pressed against the rolls 34 and 34′ by springs 42.

The shafts 14, 24 and 38 as well as the shaft 44 of the platen 32 are mounted in a frame 46. On the shaft 44 of the platen 32, driven by the drive 30, there is a broad belt pulley 48 which is connected on the one hand by a belt 50 with the coupling 26 disposed on the shaft 24 and on the other hand by a belt 52 with the shaft 38. Furthermore, shaft 24 of the transportation roll 20 is connected by a pulley 53 and an additional belt 54 and pulley 55 with a one-way or overriding clutch 56 disposed on the shaft 14 of the transportation rolls 16. The method of operation of the overriding clutch 56 is described hereinafter. Pulley 55 is larger than pulley 53 so the arrangement is such as to drive rolls 16 at a slightly lower peripheral speed than rolls 20, 22 for reasons discussed below.

The releasable coupling or clutch 26 on shaft 24 includes an electromagnet, not shown, which is operable by switch 57 when turned on to release or uncouple shaft 24 from belt 50 by actuation in the direction of arrow 58 against the force of spring 60. Hence, in the uncoupled state, shaft 24 is not driven by the running belt 50, and consequently shaft 14 is then also at a standstill.

In FIG. 2, the transportation elements are shown in that relative position in which they are mutually arranged in practice. The reference figures already mentioned have the same meaning in FIG. 2 as in FIG. 1. From this figure, it is apparent that the supply box 10 has a bottom 64, preloaded by a spring 62 in the direction of the transportation rolls 16. As a result thereof in the case of a decreasing stack of sheets 12, always the uppermost of these sheets is pressed against the transportation rolls 16, so that these rolls are capable always of seizing the uppermost sheet and feeding only it in the conveying path to the pair of transportation rolls 20, 22. For detecting the position of a sheet, there is located in the path of transportation of the sheets 12, as indicated by oppositely directed arrows in FIG. 2 and a circle in FIG. 1, a sheet feeler or sensor 66 such as a light "barrier" or beam including a conventional light source 67 and photodetector arrangement which is connected to the "on" input of electromagnetic switch 57. Whenever the rays of light from source 67 are first interrupted by the leading edge of a sheet, a signal from the photodetector 66 turns on switch 57 which disengages coupling 26 causing rolls 20, 22 and hence their grasped sheet to stop. When it is time to type or otherwise record onto that stopped sheet, programmer 31 issues a "start program" signal on line 69 to turn off switch 57 whereupon clutch 26 re-couples shaft 24 and belt 50. Now, the sheet is transported onward in the conveying path by rotated rolls 20, 22 toward platen 32 with which it is synchronized. By the contact pressure rolls 68 and 70 assigned to the platen, the conveyed sheet is then seized between the platen 32 and the first contact pressure roll 68 and is conveyed along a guide plate 72 to the second contact pressure roll 70. An arrow 74 designates that position on the platen 32 in which the conveyed sheet is lettered. The drive 30 (FIG. 1) of the platen 32 is stepwise program controlled by programmer 31 in correspondence with the lines to be lettered.

It is understood that sheet sensor 66 is positioned a predetermined distance from the lettering position 74, or a given distance from the nip between pressure roll 68 and platen 72, so that following the signal on line 69 signifying the start of a new program, impulses on line 75 step rolls 20, 22 and platen 32 an appropriate number of times to advance a desired lettering line of the sheet precisely to lettering position 74. Lettering is then accomplished exactly on line at desired transverse spaces by conventional automatic lettering (typing, printing, etc.) equipment not shown. Then programmer 31 steps motor 30 and hence the sheet to the next line, if any, to be lettered, and finally the sheet is thereby stepped off by the platen.

During or after the lettering, the sheet arrives between the cooperating pair of rolls 34, 36 by which the sheet is conveyed into the file box 76. From FIG. 3, it is apparent how the sheets 12' conveyed upwards are lifted by the teeth of the sprockets 40 with their lower egde over the roll 34. The sheet 12'' has already slipped away across the roll 34 and now has reached the stack 80 of the lettered sheets on the inclined plane 78 of the file box 76.

The photoelectric arrangement 66 may be replaced by any other sheet sensing arrangement, e.g., a microswitch or mechanical key switch with a roller switch arm or the like which protrudes into the sheet path and operates coupling 26 when first engaged by a sheet. In the case of an engaged coupling 26 (FIG. 1), the pair of transportation rolls 20, 22 is driven at the same peripheral speed as the platen 32. However, as above indicated, transportation rolls 16 disposed on shaft 14 are driven with a slightly lower peripheral speed than the pair of rolls 20, 22. This is done so that an interval is formed between two successive sheets in order to provide sufficient spacing therebetween in the area of sensor 66 for the sensing of the next sheet by sensor 66. However, to balance out or equalize the peripheral speed between the transportation rolls 16 and 20, 22, transportation rolls 16 may be pulled along at a greater speed by a sheet simultaneously grasped by rolls 16 and 20, 22 by virtue of the usual overriding feature of the conventional one-way clutch 56 which allows shaft 14 to overtake or run faster than its driving element in clutch 56.

Although belts have been provided in the embodiment shown for the transmission of the rotational movements, gear mechanisms may be used in their place.

What is claimed is:

1. In apparatus for transporting separate sheets of paper or the like through equipment by which information can be imparted onto each sheet line by line, the combination of:

a platen rotatable to and past a given angular position at which said information can be imparted onto a sheet disposed on said platen;

means for driving said platen stepwise, means including at least one feed roll for feeding said separate sheets singularly from a supply into a conveying path toward said platen, a cooperating pair of transporting rolls disposed in said path between said feeding means and platen for grasping a fed sheet and feeding it onward toward said platen when at least one of said transporting rolls is driven, said transporting rolls being located in said path downstream from said feed roll a distance less than the path length of a said sheet, means for maintaining said feed roll in constant and continuous pressure contact with said sheet supply and with each single sheet fed by said feed roll until after the fed sheet is grasped by said transporting rolls for constantly and continuously controlling the movement of each sheet by said feed roll until after it is under the control of said transporting rolls, roll drive means including releasable coupling means connected between said platen and said one transporting roll for driving said one transporting roll by said platen, sheet sensing means coupled to said releasable coupling means for detecting the advancement of a sheet along said path to a predetermined sensing position located a fraction of said sheet length downstream from said transporting rolls for releasing said coupling means to stop the drive of said transporting rolls and halt the said onward feeding thereby of a sheet which is then under grasp by said transporting rolls, means for restarting the onward feeding of a sheet past said sensing means and through said platen of the halted sheet by re-engaging said coupling means to cause driving of said transporting rolls again, said platen having at least one nip located downstream from said transporting rolls a distance less then the path length of a fed sheet for keeping a sheet fed by the transporting rolls under control thereof at least until the sheet is grasped by the platen at said nip, and means cooperating with said feeding means and coupling means for causing said feed roll to feed a sheet forward upon said re-engaging of said coupling means but at a speed slower than said transporting rolls for spacing successive sheets to allow detection thereof by said sheet sensing means, said predetermined sensing position being spaced a given distance from said angular position so that said information can be imparted onto said sheet precisely on each desired predetermined line of said sheet as it is stepped by said platen and its driving means.

2. Apparatus as in claim 1 wherein said transporting rolls are driven by said roll drive means at the same speed as said platen.

3. Apparatus as in claim 1 wherein said releasable coupling means includes an electromagnetic clutch.

4. Apparatus as in claim 1, 2 or 3 wherein said one feed roll is driven simultaneously with the said pair of transporting rolls.

5. Apparatus as in claim 4 including feed roll drive means connected between said one transporting roll and said feed roll and including a one-way clutch for allowing said feed roll to be pulled at the peripheral speed of said transporting rolls by a sheet simultaneously grasped by said transporting rolls.

6. Apparatus as in claim 1 wherein said sheet sensing means includes a light source-detector arrangement.

7. Apparatus as in claim 1 including at least one pair of second transporting rolls for conveying a sheet from said platen onwards and into a predetermined location and means including teeth assigned to one of said second rolls for lifting the sheet away and conveying it onward from the said assigned roll.

* * * * *